US005918802A

United States Patent [19]

Petkovsek

[11] Patent Number: 5,918,802

[45] Date of Patent: Jul. 6, 1999

[54] SPECIAL SERVICE ENVELOPE AND A METHOD FOR MAILING A MAILPIECE REQUIRING A SPECIAL SERVICE

[76] Inventor: Glenn Petkovsek, 20 Tortoise Park Cove, Little Rock, Ark. 72211-2349

[21] Appl. No.: 08/804,611

[22] Filed: Feb. 24, 1997

Related U.S. Application Data

[63] Continuation-in-part of application No. 08/473,266, Jun. 7, 1995, abandoned, which is a continuation-in-part of application No. 08/332,893, Nov. 1, 1994, abandoned.

[51] Int. Cl.[6] ..... B65D 27/06

[52] U.S. Cl. ..... 229/300; 229/92.8

[58] Field of Search ..... 229/300, 92.8

[56] References Cited

U.S. PATENT DOCUMENTS

| | | | |
|---|---|---|---|
| 444,979 | 1/1891 | Harrison et al. | 229/92.8 |
| 1,511,948 | 10/1924 | Coleman | 229/300 |
| 1,568,880 | 1/1926 | Conklin | 229/300 X |
| 2,153,504 | 4/1939 | Didier | 229/92.8 X |
| 2,328,380 | 8/1943 | Feder | 229/300 |
| 3,229,893 | 1/1966 | Stein | 229/301 |
| 3,937,492 | 2/1976 | Biron | 229/92.3 |
| 4,418,865 | 12/1983 | Bowen . | |
| 4,429,827 | 2/1984 | Murray | 229/300 X |
| 4,565,317 | 1/1986 | Kranz . | |
| 4,682,793 | 7/1987 | Walz . | |
| 4,801,076 | 1/1989 | Schoenleber et al. | 229/92.8 |
| 4,892,246 | 1/1990 | Norman | 229/92.8 |
| 5,183,203 | 2/1993 | Sanders | 229/300 |
| 5,190,210 | 3/1993 | Walz . | |
| 5,316,208 | 5/1994 | Petkovsek | 229/300 X |
| 5,397,052 | 3/1995 | Walz | 229/69 X |
| 5,626,286 | 5/1997 | Petkovsek | 229/300 |

FOREIGN PATENT DOCUMENTS

| | | | |
|---|---|---|---|
| 363844 | 8/1906 | France | 229/300 |
| 145 | 1/1878 | United Kingdom | 229/300 |
| 11375 | 7/1892 | United Kingdom | 229/92.1 |
| 15215 | 11/1990 | United Kingdom | 229/300 |

*Primary Examiner*—Jes F. Pascua

*Attorney, Agent, or Firm*—Patents & TMS; Brian M. Mattson

[57] ABSTRACT

A system for mailing an article requiring special services and a method for forming a mailpiece having an interior for carrying an article requiring special services are provided. The system includes an integrally formed envelope and form constructed from a single sheet and folded and sealed in such a way that one portion of the assembly provides an envelope and the other portion provides a return postcard for attachment to the envelope in its assembled position. The parts are integrally formed, but removably attached, such that the return postcard remains attached to the envelope until received by the addressee upon which the return postcard may be removed.

2 Claims, 7 Drawing Sheets

SPECIAL SERVICE ENVELOPE AND A METHOD FOR MAILING A MAILPIECE REQUIRING A SPECIAL SERVICE

This is a continuation-in-part of application Ser. No. 08/473,266, filed Jun. 7, 1995 now abandoned, which is a continuation-in-part of U.S. application Ser. No. 08/332,893 filed Nov. 1, 1994, now abandoned.

BACKGROUND OF THE INVENTION

The present invention generally relates to a combined form and envelope for mailing an article requiring special services. More specifically, the present invention relates to a combined form and envelope for mailing an article requiring special services wherein a form or return postcard is attached to the envelope prior to assembly or formation of the mailpiece including the form and the envelope.

It is, of course, generally known to mail an article requiring special services for delivery of the article, such as certified mail, registered mail, insured mail, COD, return receipt for merchandise and the like. Known components and methods for assembling a mailer for mailing an article requiring special services have multiple, separate components requiring attachment to an exterior of an envelope for the special services delivery of the article.

For example, when a customer of the U.S. Postal Service requires an article to be mailed by certified mail, for example, an envelope containing the article is provided to the postal employee by the customer. The postal employee is then required to attach or otherwise provide the envelope with a permanent seal or label indicating that the envelope requires delivery by certified mail.

Then, a return postcard requiring attachment to the envelope, must be completed by the postal employee and/or the customer mailing the envelope containing the article. Some postcards include areas having an adhesive for attachment of the postcard to the envelope. Other postcards require separate attachment, such as using tape, for example.

Such a procedure is both complex and time-consuming, as well as labor intensive. The procedure requires the postal employee to ensure that all of them appropriate labels and documents are affixed to the envelope prior to delivery of the article. Therefore, the appropriate forms, labels and the like must be adequately stocked and available for the postal employee. Further, the postal employee must ensure that all articles are appropriately affixed to the envelope. In addition, the return postcard must be suitably affixed such that the return postcard is not removed during the mailing of the article to its destination. Of course, it should be understood that an envelope being prepared for special service mailing may be prepared by any individual, not just a postal employee.

A need, therefore, exists for an improved method for assembling a mailpiece requiring special services and a system for mailing an article requiring special services, such as certified mail, insured mail, registered mail, COD, return receipt for merchandise and the like.

SUMMARY OF THE INVENTION

The present invention provides a system and a method for mailing and forming a mailpiece for mailing an article requiring special services, such as for certified mail, insured mail, register mail, COD, return receipt for merchandise and the like. The system includes a combined mailing assembly formed from a single sheet folded and sealed such that a portion of the folded sheet provides an envelope having an interior compartment and the other portion of the folded sheet provides a return postcard and appropriate sealing sections.

To this end, in an embodiment of the present invention, a system is provided for mailing an article requiring special services. The system comprises an envelope having an interior compartment formed by a sheet folded then sealed along three sides to form the interior compartment wherein the sheet extends beyond one of the sealed sides to form a return postcard wherein the return postcard is integrally formed with the sheet forming the envelope and is selectably detachable from the envelope.

In an embodiment, the system further has a flap extending from an unsealed side of the envelope to selectively enclose the envelope when separately sealed.

In an embodiment, the system has a sealing section adjacent to the return postcard in a portion of the sheet extending beyond one of the sealed sides.

In an embodiment, the system has a perforated tear line formed in a portion of the sheet extending beyond one of the sealed sides for removing the return postcard from a remainder of the sheet including the envelope.

In an embodiment, the system has a removable section adjacent the width of the envelope.

In an embodiment, the system further has a first sealing section adjacent the return postcard in a portion of the sheet extending beyond one of the sealed sides and a second sealing section adjacent the return postcard in a portion of the sheet extending beyond one of the sealed sides wherein the first sealing section and the second sealing section are at opposite ends of the return postcard.

In an embodiment, the system has a fold line at a junction of a portion of the sheet extending beyond one of the sealed sides and one of the sealed sides.

In another embodiment of the present invention, a method is provided for forming a mailpiece having an interior carrying an article requiring special services. The method comprises the steps of: providing an envelope for carrying an article requiring special services; providing a return postcard integrally formed with the envelope; and securing the return postcard to the envelope.

In an embodiment, the method further comprises the steps of: providing a fold line at a junction between the envelope and the return postcard; and folding at the fold line at the junction before securing the return postcard to the envelope.

In an embodiment, the method further comprises the step of providing a sealed section to secure the return postcard to the envelope.

In an embodiment, the method further comprises the step of providing a perforated tear line to assist in removing the return postcard from the envelope after securing the return postcard to the envelope.

In an embodiment, the method further comprises the step of removing a strip along the envelope prior to securing the return postcard to the envelope wherein the strip includes an identifier related to the mailpiece.

In an embodiment, the method further comprises the step of providing a designator on the envelope indicative of the special services required.

In an embodiment, the method further comprises the step of providing an instruction section to assist in forming the mailpiece.

In another embodiment of the present invention, a combined mailing assembly is provided for mailing an article requiring special services. The assembly comprises a single sheet folded substantially in half and sealed at a point intermediate its ends, after folding, and further sealed along the sides to form an envelope having an interior compartment and further to form a return postcard separated from the envelope at a point intermediate the ends.

In an embodiment, the assembly further has a sealed section adjacent the return postcard having an adhesive for securing the return postcard on the envelope.

In an embodiment, the assembly further has a perforated tear line constructed and arranged to remove the return postcard.

In an embodiment, the assembly further has a removable strip adjacent the envelope including article identifying numbers related to the special services required for the article.

In an embodiment, the assembly further comprises an integrally formed sealing flap constructed and arranged to selectively enclose the interior compartment of the envelope.

In an embodiment, the assembly further comprises a fold line at the point intermediate the ends running along a base of the envelope and the top of the return postcard such that, when the single sheet is folded at the folded line, the return postcard may be secured to the envelope.

It is, therefore, an advantage of the present invention to provide an improved system for mailing an article requiring special service.

Another advantage of the present invention is to provide a simplified method for forming a mailpiece for carrying an article requiring special services.

And, another advantage of the present invention is to provide a system and an assembly that is integrally formed as a complete unit for mailing and labeling of an article requiring special services.

Yet another advantage of the present invention is to provide a system for mailing an article and a method for forming a mailpiece requiring special services without requiring additional adhesives or fixatives for attaching the same to the mailpiece.

Moreover, an advantage of the present invention is to provide a system for mailing an article requiring special services and a method for forming a mailpiece for carrying an article requiring special services that is substantially foolproof.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an assembly for mailing an article requiring special services. Further, the present invention provides a method for forming a mailpiece having an interior for carrying articles requiring special services.

Figure 1:
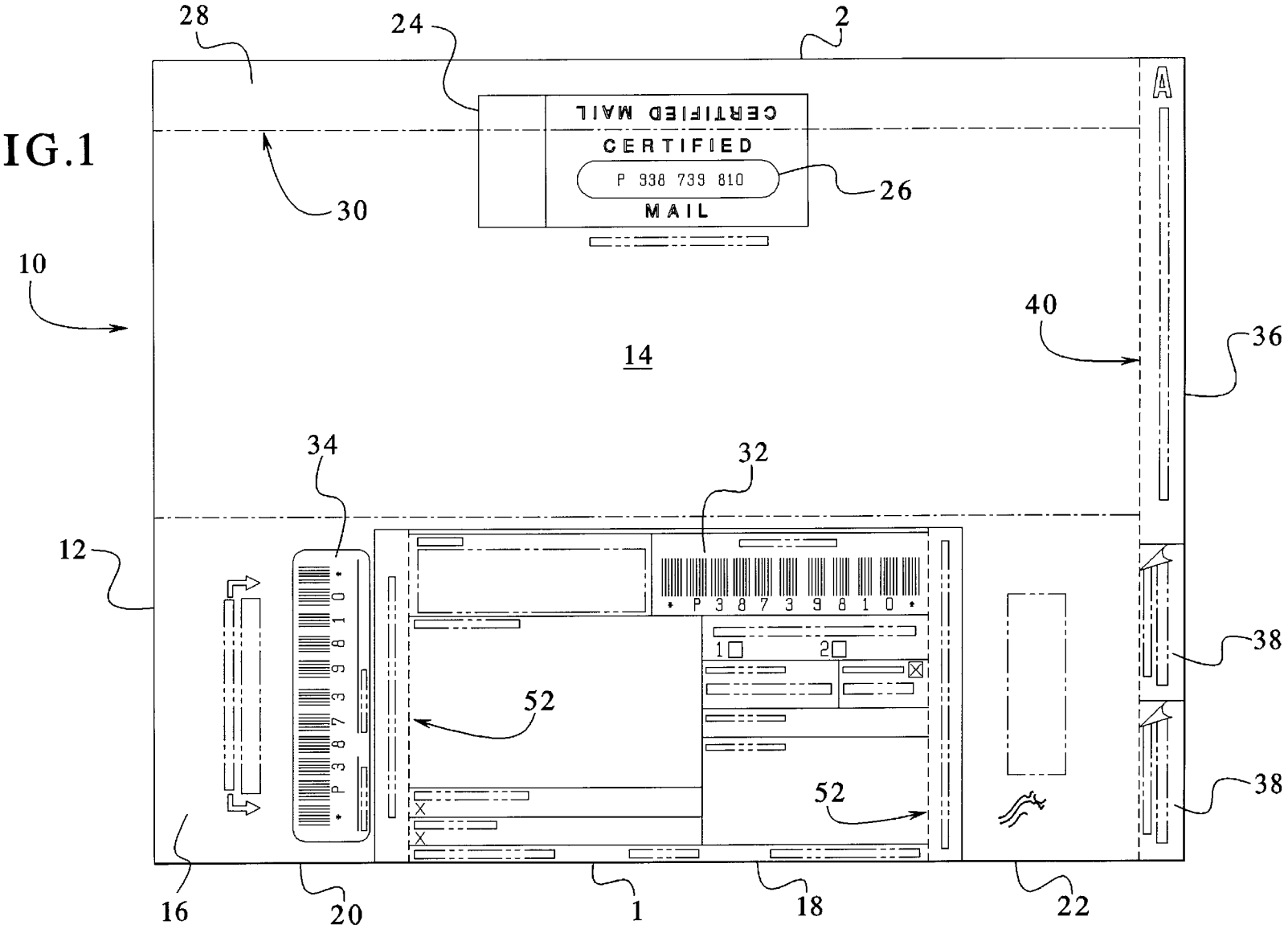
FIG. 1 illustrates a top plan view of an embodiment of an assembly of the present invention.

Referring now to the drawings, wherein like numerals refer to like parts, FIG. 1 generally illustrates an assembly 10 formed from a single sheet 12 folded in a manner to provide both a compartment and a return postcard for mailing an article within the compartment requiring a special service therefor. Although a certified mail envelope is illustrated, it should be understood that the present invention is applicable to any mailing item requiring special services, such as insured mail, registered mail, COD, return receipt for merchandise and the like.

The assembly 10 illustrated in FIG. 1 on its front side includes a top half 14 forming one side of an envelope and a bottom half 16 including a return postcard 18 and sections 20 and 22 adjacent to the return postcard 18. The top half 14 of the assembly 10 includes, in a preferred embodiment, a pre-printed label 24 indicative of the special service required for mailing of the assembly 10.

In a preferred embodiment, the label 24 is pre-printed directly on the top half 14 of the assembly 10. In another embodiment of the present invention, the pre-printed label 24 may be adhesively attached to the top half 14 of the assembly 10.

The pre-printed label 24 includes a window section 26 including an article identification number. The pre-printed label 24 is constructed an arranged such that the type of special service required for mailing of the assembly 10 is visible from both a front side of the top half 14 and a rear side of the top half 14 as more clearly illustrated in FIGS. 3 and 5. The assembly 10 is formed between a first end 1 and a second end 2. To this end, a sealing flap 28 is provided having a fold line 30 dividing the pre-printed label 24, as illustrated, such that a portion of the pre-printed label 24 is visible from the reverse side of the envelope after folding the sealing flap 28 at the fold line 30.

The bottom half 16 of the assembly 10 includes the return postcard 18. The return postcard 18 has a number of sub-sections requiring completion by the sender prior to mailing the assembly 10 to the addressee on the top half 14 of the envelope section. One sub-section illustrated at numeral 32 includes a machine readable article identification number corresponding to the number in the window section 26 of the pre-printed label 24. The sub-section 32 may have a background color contrasting the remainder of the return postcard 18 so as to simplify the reading of the machine-readable code in the sub-section 32. Other sections, as well, may include similar color-contrasting portions within the return postcard 18. The section 22 may also include a sub-section 34 including machine-readable indicia with the article identification number corresponding to the number in the sub-section 32 and to the number in the window section 26 of the pre-printed label 24.

A detachable strip 36 which includes an article identifying tab 38 is provided along a width of the assembly 10 and is removable from the assembly 10 by a perforated tear line 40. The article identifying tab 38 may be adhesively backed for subsequent attachment to a receipt or other item requiring designation of the article number for related purposes. As illustrated, two article identifying tabs 38 are provided.

Figure 2:
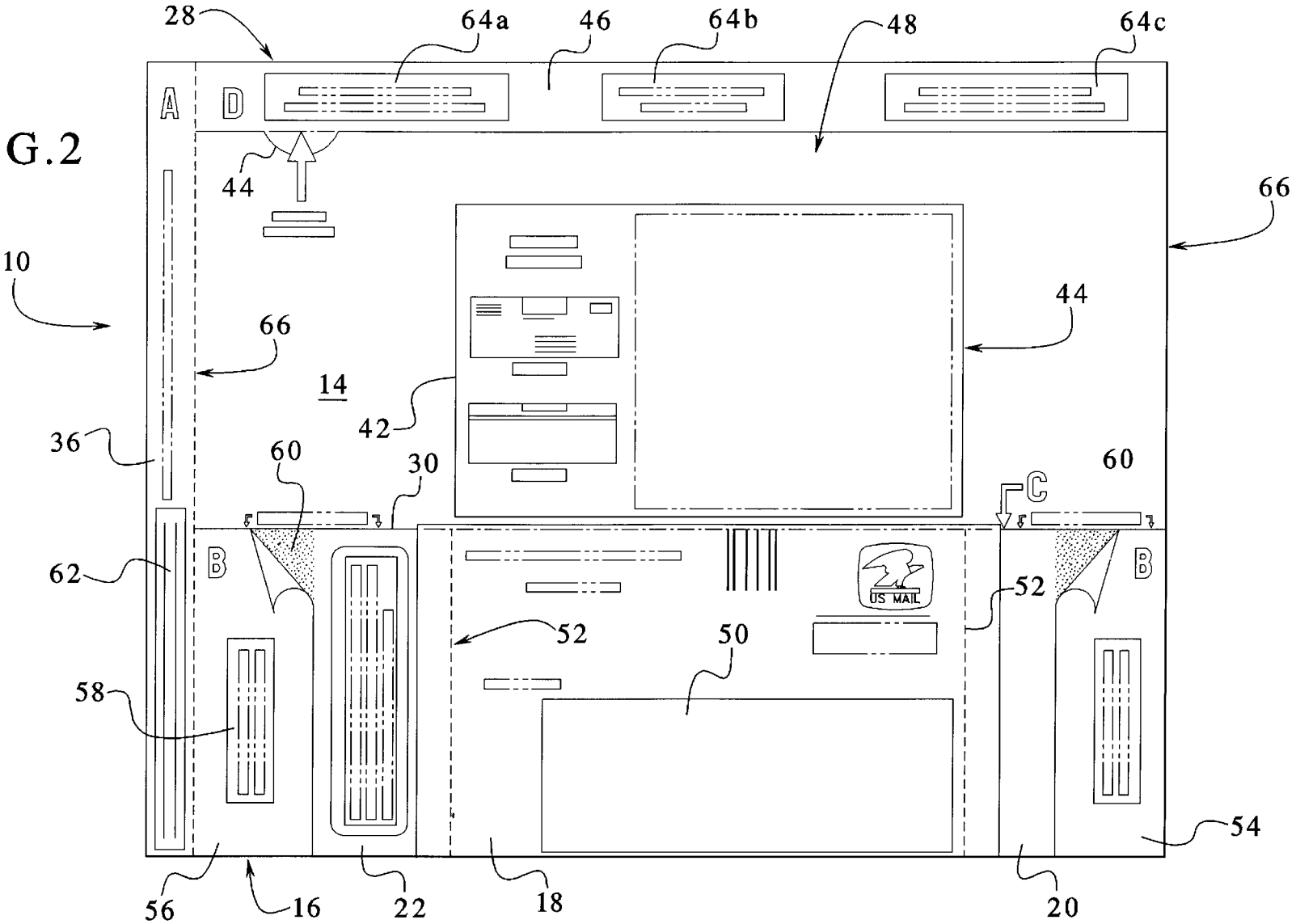
FIG. 2 illustrates a rear plan view of an embodiment of an assembly of the present invention.

Referring now to FIG. 2, a backside of the assembly 10 is illustrated. The reverse side of the top half 14 shown in FIG. 1 is, therefore, illustrated providing a backside of an envelope of the assembly 10.

The top half 14 of the backside includes an instruction section 42 including instructions generally designated at 44 for completing the forms, such as the return postcard, and instructions for assembling the assembly 10 following completion of the required section. Within the top half 14 of the assembly 10 is a thumb-notched section 44. The thumb-notched section 44 is cut out from the top half 14 of the assembly 10 such that a pull-tab 46 covering an adhesive therebeneath may be exposed. The adhesive seals an opening 48 of the top half 14 by folding the sealing flap 28 such that the sealing flap 28 covers the thumb-notched section 44 and further encloses the opening 48 following insertion of an article, such as a letter, inserted into a compartment formed by the top half 14.

The bottom half 16 of the assembly 10 includes a front side of a return postcard 18. The return postcard 18 includes a "Return To" section 50. The "Return To" section 50 may be color-contrasted with the remainder of the return postcard to enable simplified reading of the "Return To" section 50. Perforated tear lines 52 are provided along exterior sides of the return postcard 18. The return postcard 18 is preferably wider than the locations of the perforated tear lines 52 to maintain permanent and selective attachment of the return postcard 18 to the bottom half 16 of the assembly 10.

Figure 4:
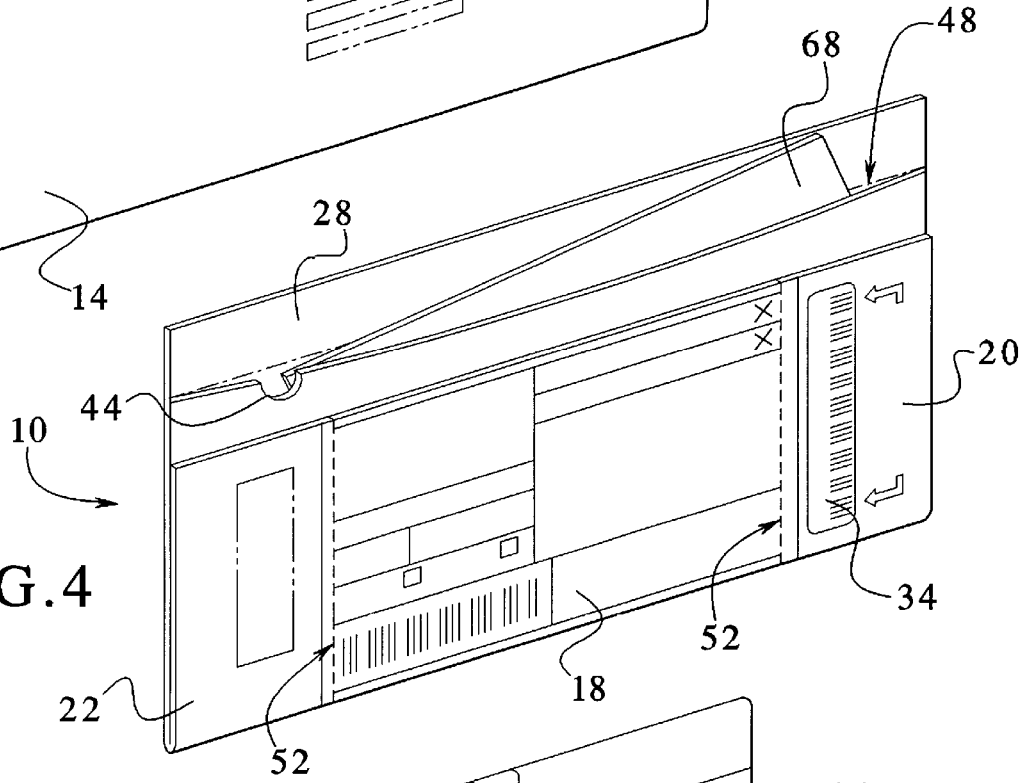
FIG. 4 illustrates a perspective view of a rear side of an embodiment of an assembly of the present invention.

The backside of the sections 20,22 include removable section 54,56, respectively. The removable sections 54,56, when removed, expose an adhesive or sealed area 60 thereunder such that when the assembly 10 is folded at the fold line 30, the adhesive 60 attaches to the backside of the top half 14 as illustrated in FIG. 4. The removable sections 54,56 include instructions sections 58 indicating to a user that removal of the removable sections 54,56 is required to expose the adhesive 60 thereunder. The detachable strip 36 may also include instructions with respect to removal of the tabs and identifying section 62 indicating the purpose of the article identifying tabs 38 on the reverse side thereof.

The pull-tab 46 also includes instructions sections 64*a*, 64*b* and 64*c*. The instructions sections 64*a*, 64*b* and 64*c* assist in identifying and instructing that the pull-tab 46 must be removed to seal the sealing flap 28 upon insertion of an article or document through the opening 48 into the compartment of the envelope in the top half 14 of the assembly 10. The assembly 10 is sealed along the fold line 30 as well as along the sides 66 of the assembly 10.

Each of the parts requiring removal or the areas about which instruction is required for forming the assembly is designated in large capital letters. To assemble the mailer, the detachable strip 36 designated with "A" must be removed from the assembly 10. The strip contains the article identifying tab 38 which may also be removed for internal records or discarded. The removable sections, 54,56 designated "B" are removed, then each side of the return postcard 18 of the assembly 10 is folded at the fold line 30 designated "C" so that the adhesive 60 below the removable sections 54,56 adheres to the back side of the envelope at the top half 14 of the assembly 10. The document, such as a letter, is then inserted through the opening 48 at the top half 14 of the assembly 10. Then the pull tab 46 designated at "D" is removed and folded to seal the sealing flap 28 in a sealed position by an adhesive beneath the pull tab 46.

Figure 3:
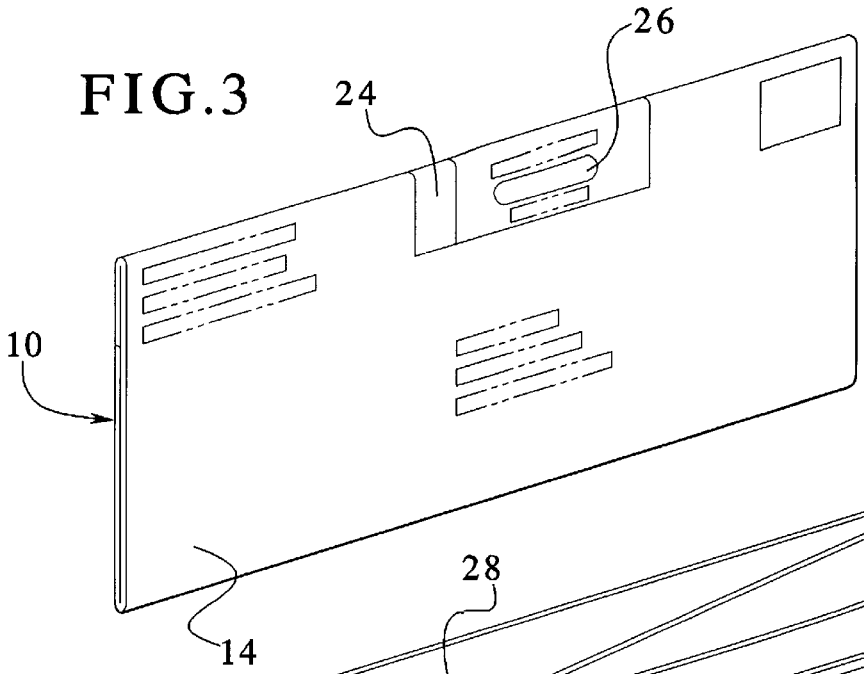
FIG. 3 illustrates a perspective view of a front side of an embodiment of an assembly of the present invention.
Figure 5:
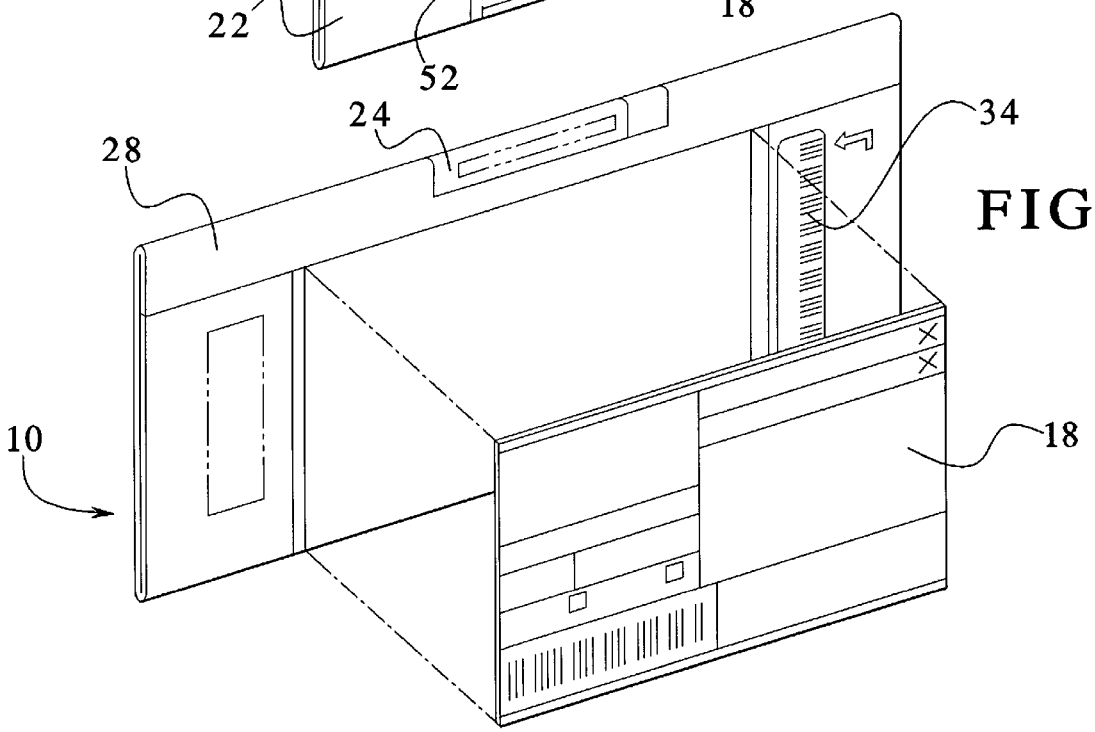
FIG. 5 illustrates a perspective view of a rear side of an embodiment of the assembly of the present invention with a portion thereof detached.

Referring to FIGS. 3–5, a completed assembled envelope from its front side is illustrated in FIG. 3 and from its back side in FIG. 4 with the sealing flap 28 in an unsealed position. The pre-printed label 24 is shown having a window section 26 in which a certified mail number may be printed either manually or automatically.

FIG. 4 illustrates the return postcard 18 in its position attached to the backside of the top half 14 of the assembly 10 by the adhesive 60 from sections 54,56 removed from the backsides of the sections 20,22. The perforated tear lines 52 along the width of the return postcard 18 allow removal of the return postcard 18 following delivery of the assembly 10.

FIG. 4 further clearly illustrates a document 68 inserted through the opening 48 into a compartment formed by an envelope section of the assembly 10. Following insertion of the document 68 into the opening 48, the sealing flap 28 may be secured to enclose the assembly 10 as shown in FIG. 5.

FIG. 5 further illustrates the return postcard 18 removed from the envelope section of the assembly 10 by tearing at the perforated tear lines 52. As clearly illustrated in FIG. 5, the pre-printed label 24 is visible on a backside of the mailpiece following sealing of the sealing flap 28.

The sub-section 34 on the section 20 of the bottom half 16 of the assembly 10 is also designed to be removable and serve as a postal receipt. That is, the section includes a bar-coded article number and a signature and date line wherein the sender may sign on the line within the sub-section 34 and date the same and the postal office or other designated sender may retain the sub-section within its records indicating the article number and the date on which the assembly 10 was mailed as attested to by the signature of the sender.

Figure 6:
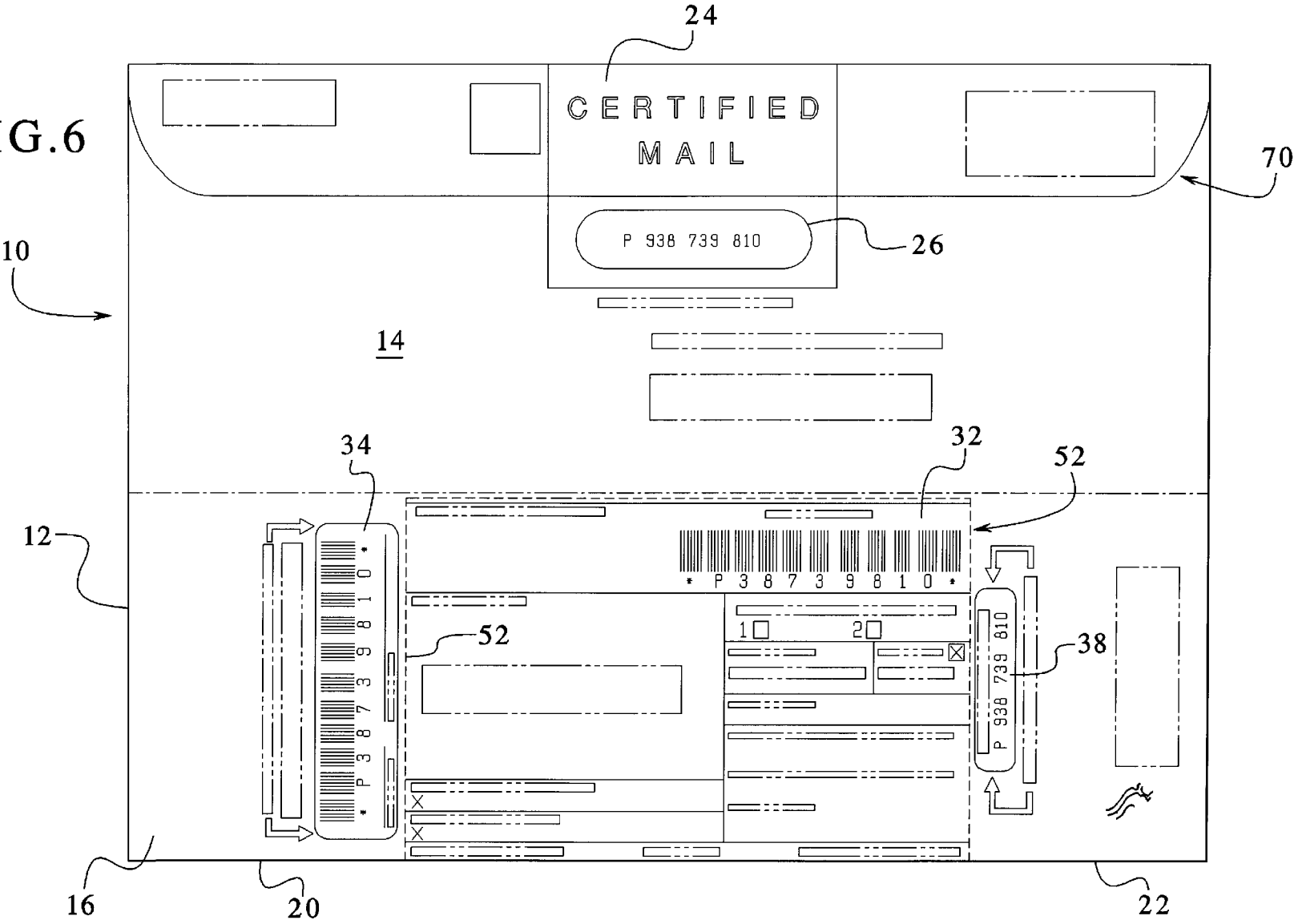
FIG. 6 illustrates a top plan view of another embodiment of an assembly of the present invention.

FIG. 6 illustrates another embodiment of the assembly 10 of the present invention, wherein like numerals represent like parts. The embodiment shown provides a somewhat simplified assembly since it does not have the detachable strip 36 as in the prior embodiment illustrated in FIGS. 1–5. The front side of the embodiment shown in FIG. 6 also includes a sealing flap 70 located at the top of the envelope 14. Also, only one article identifying tab 38 is shown although additional identifying tabs may be provided. In the embodiment of the present invention shown in FIGS. 6 and 7, the article identifying tab 38 is located on the section 22 and may be adhesively backed for easy removal and use.

Figure 7:
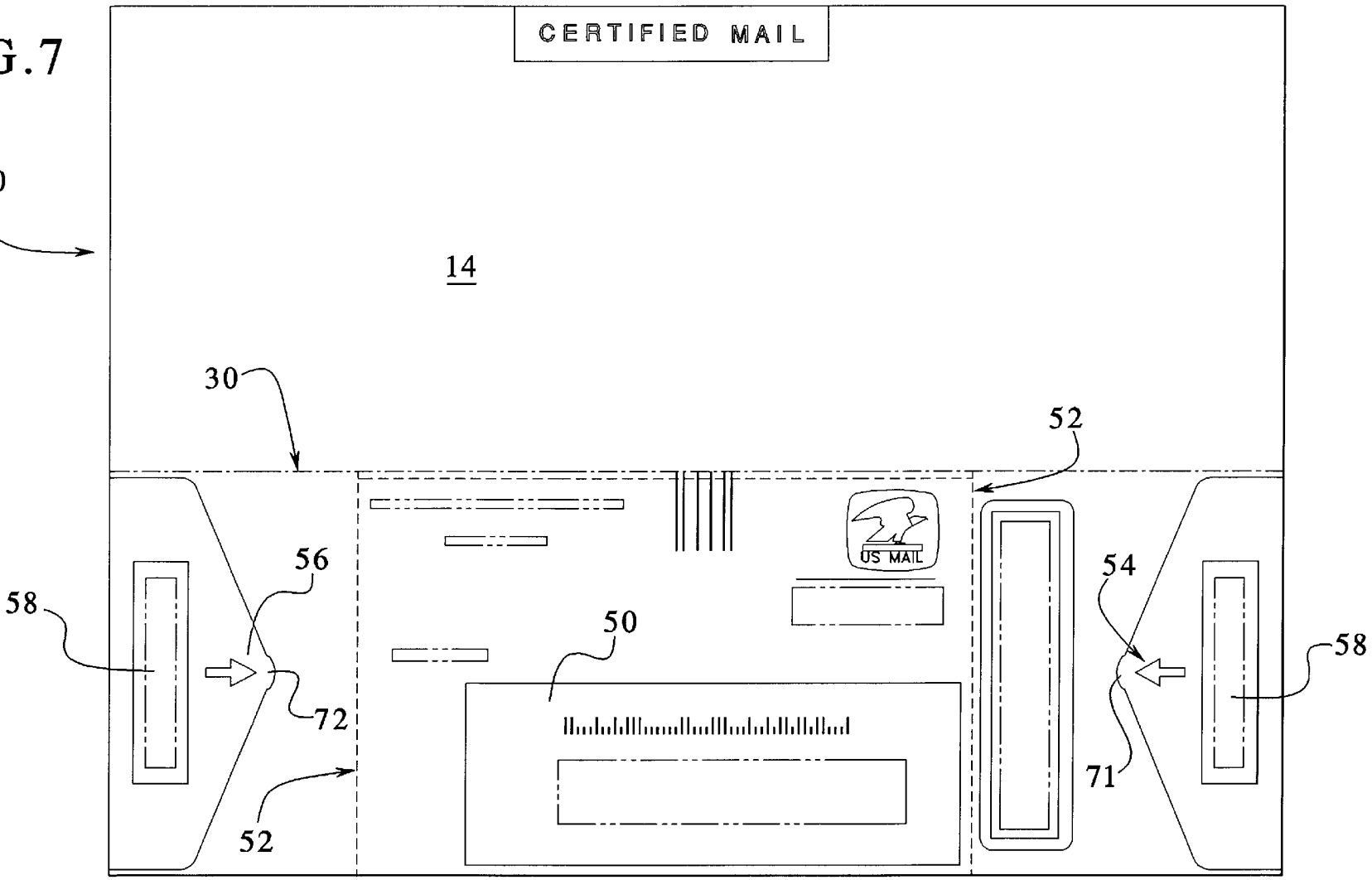
FIG. 7 illustrates a rear plan view of another embodiment of an assembly of the present invention.

FIG. 7 illustrates the back side of the embodiment of the assembly 10 shown in FIG. 6. Also, the removable sections 54, 56 may include instruction sections 58 indicating to the user that removal of the removable sections 54, 56 is required to expose the adhesive 60 (not shown in FIG. 7, see FIG. 2) thereunder. The removable section 54, 56 are preferably constructed having pull tabs 71, 72, respectively. The pull tabs 71, 72 assist the user in removing and peeling sections 54, 56 to expose the adhesive 60. After the removable sections 54, 56 are peeled back to expose the adhesive 60, the bottom half 16, including the return postcard 18, is folded along the fold line 30 and sealed to the top half 14. In this manner, the assembly 10 forms a standard size envelope that can be processed in an automated manner.

Figure 8:
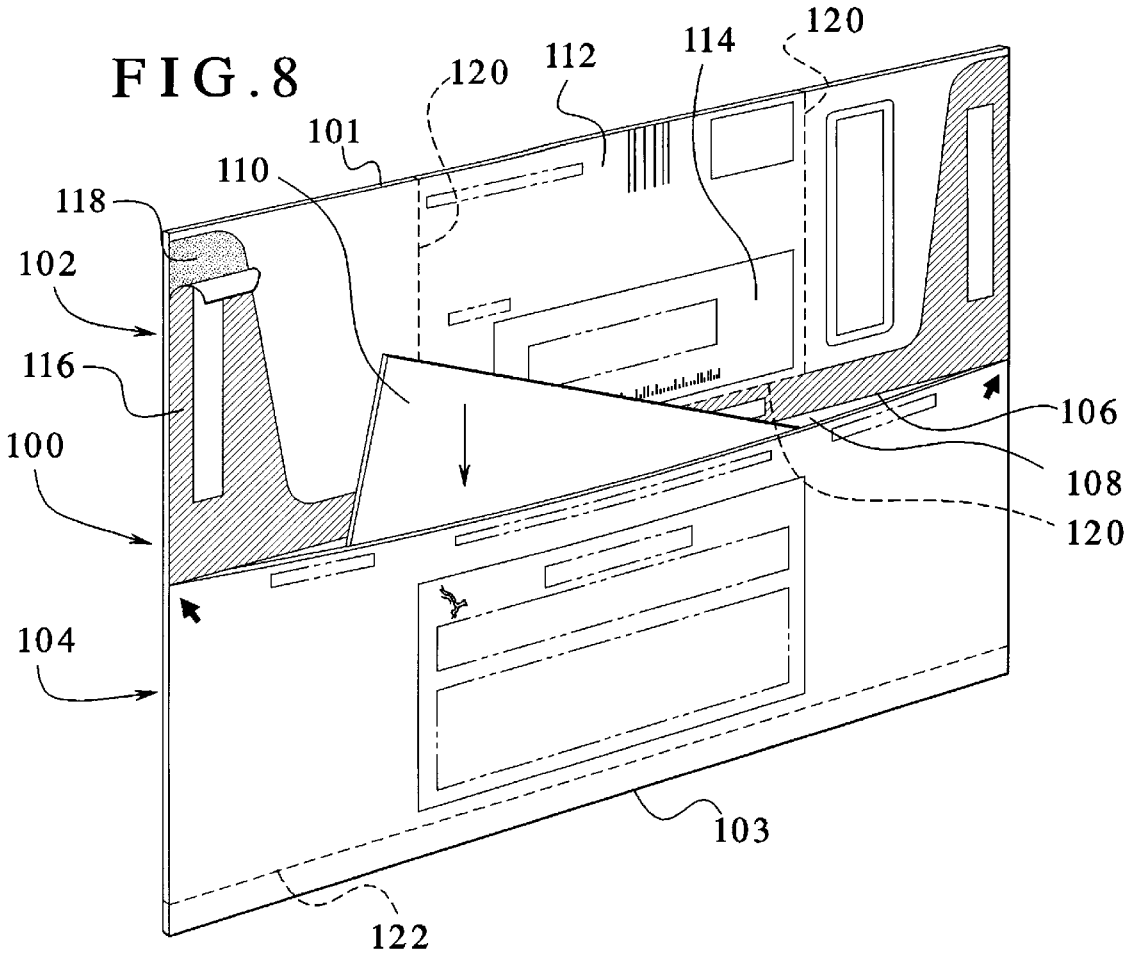
FIG. 8 illustrates a perspective view of one side of an embodiment of the present invention with an insert being placed into a compartment.
Figure 9:
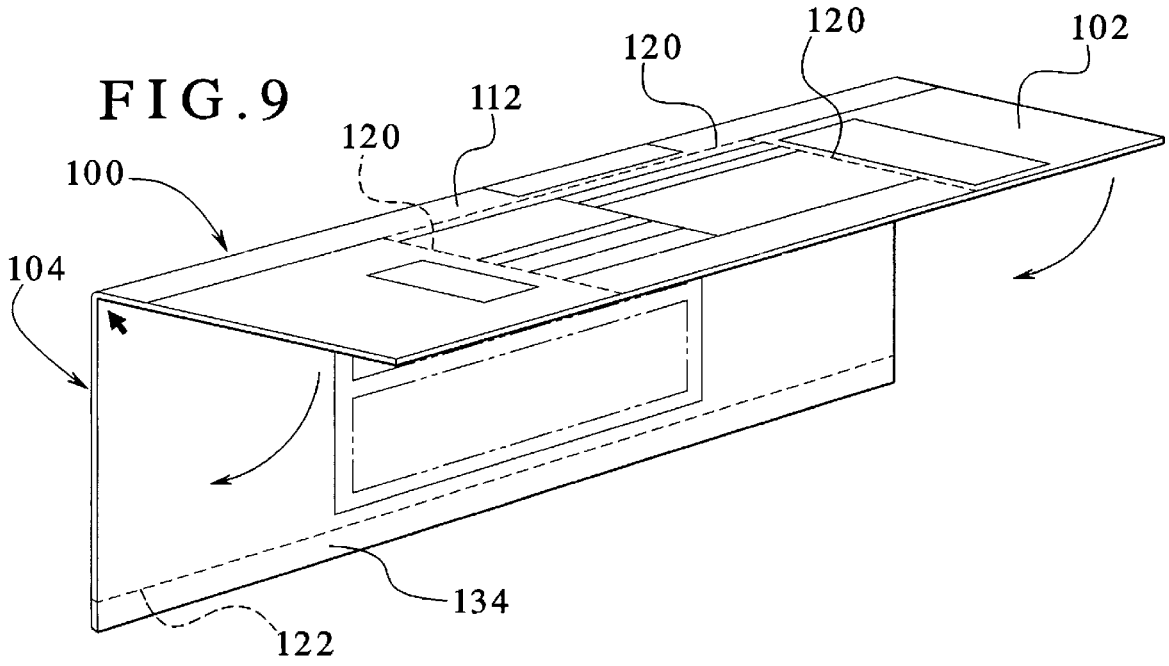
FIG. 9 illustrates a perspective view of an embodiment of the present invention with one portion being folded to attach to another portion.

Referring now to FIGS. 8–11, another embodiment of an assembly 100 is illustrated. The assembly 100 includes a top half 102 and a bottom half 104 generally separated by a fold line 106. The assembly 100 is formed between a first end 101 and a second end 103. At the fold line 106, entry into a compartment 108 formed in the bottom half 104 is generally provided. The item 110 requiring delivery by special services may be inserted into the compartment 108 for delivery thereof. Formed in the top half 102 is a return postcard 112 including a section 114 that may be variably printed with information regarding to whom the postcard should be returned following delivery of the mailpiece. To use the assembly 100, after all necessary information is printed on each side of the assembly 100, including the "Return To" section 114 shown in FIG. 8, removable section 116 that extends across the top half 102 as illustrated in FIG. 8 is removed from the top half 102 to expose an adhesive 118 or sealed area thereunder. As shown in FIG. 9, after insertion of the item 110 into the compartment 108, the assembly 100 is folded at the fold line 106 such that the adhesive from the top half 102 mates with areas on the bottom half 104 enclosing the item 110 in the compartment 108 of the assembly 100. The return postcard is separable from the remainder of the assembly 100 by perforated tear lines 120 on each side of the return postcard 112 and the top half 102 of the assembly 100. Another perforated tear line 122 extends along the width of the bottom half 104, the function of which will be described hereinafter.

Figure 10:
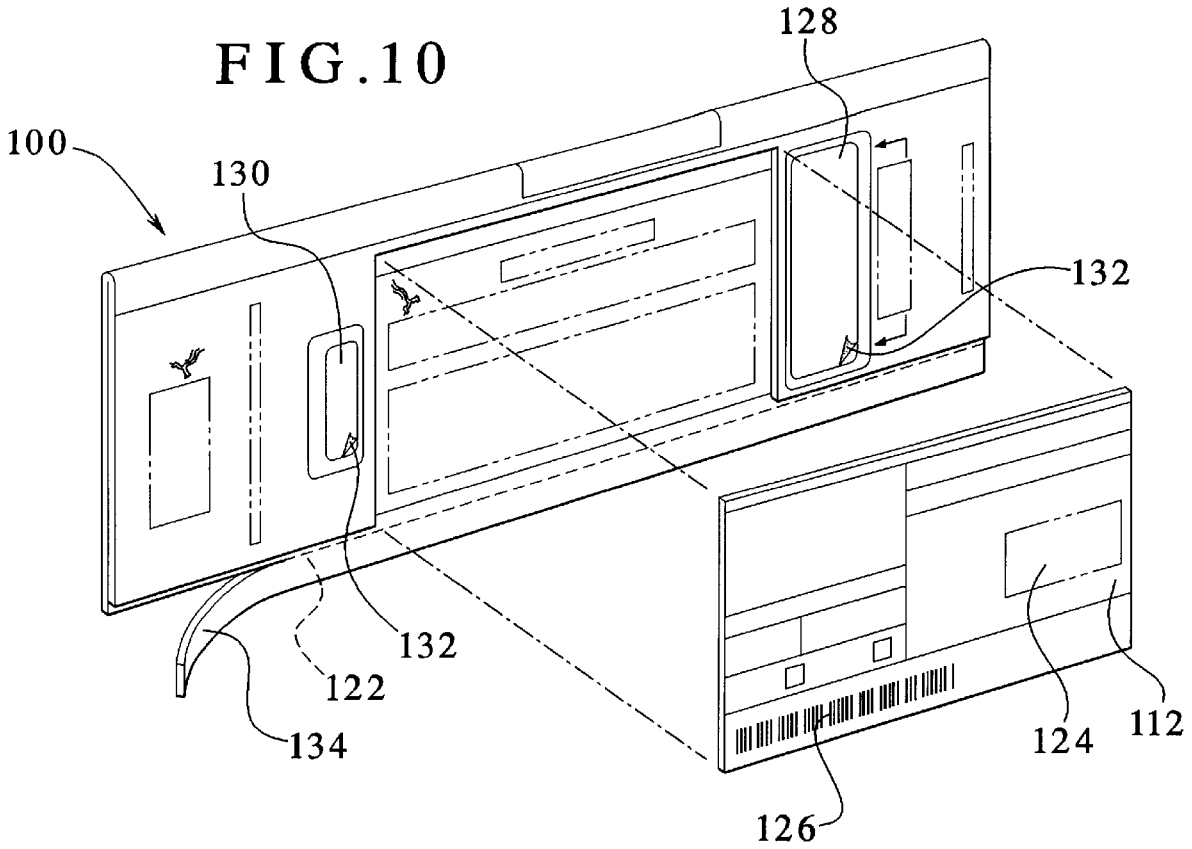
FIG. 10 illustrates a perspective view of a return postcard being removed from a remainder of the assembly and an edge of the envelope partially removed therefrom.
Figure 11:
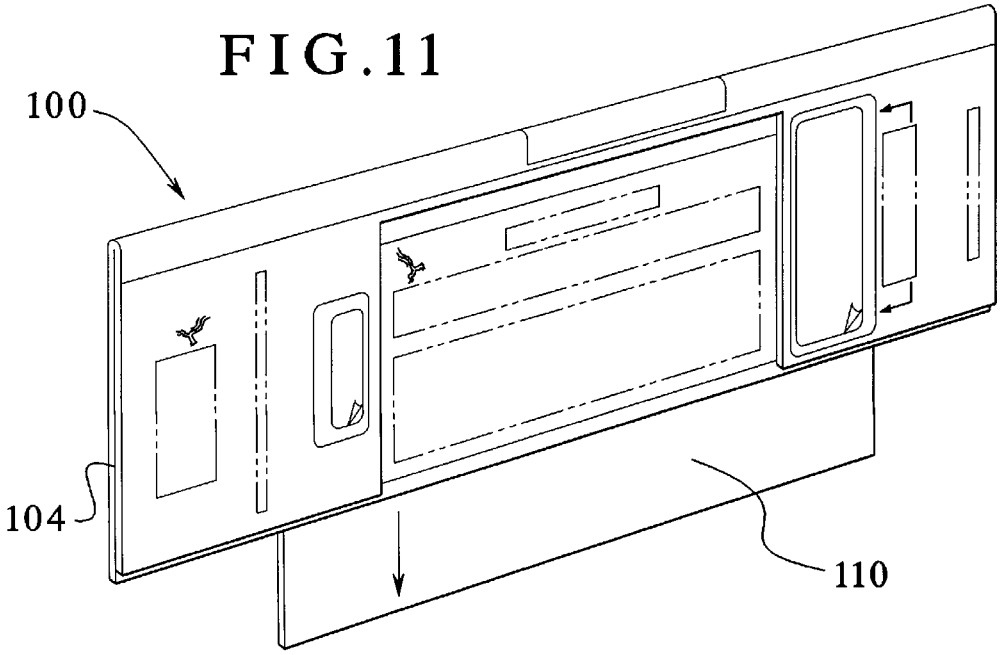
FIG. 11 illustrates a perspective view of an embodiment of the assembly of the present invention with the edge removed for removing the contents from the compartment in which the same was held.

As shown in FIGS. 10 and 11, the return postcard 112 is removable from the assembly 100 by detaching the same along the perforated tear line 120. The return postcard 112 is printed with variable information including an addressee section 124 which corresponds to the address to which the assembly 100 is forwarded that is on an opposite side from the return postcard 112 when the assembly 100 is folded in the arrangement shown in FIG. 10. The return postcard 112 may also be printed with a machine readable code 126 to track delivery of the assembly 100. The machine readable code 126 corresponds to the article number for the assembly 100 and its delivery. Two additional labels 128,130 with adhesives 132 provided on their reverse sides may also be provided to assist tracking of the assembly 100 by both the delivery service as well as the receiver of the assembly 100. A top side of the return postcard 112 is also provided with a perforated tear line 120 as illustrated in FIG. 9 for removal of the return postcard 112 from the top half 102 of the assembly 100.

As shown in FIG. 10, the perforated tear line 122 along the width of the bottom half 104 of the assembly 100 is detachable therefrom following delivery of the assembly 100. The return postcard 112 is preferably removed and returned to the sender of the assembly 100. Then, the strip 134 is removed from the bottom half 104 of the assembly 100 at the perforated tear line 122. As a result, as shown in FIG. 11, the item 110 is removable from the compartment 108 in the bottom half 104 of the assembly 100. This arrangement allows removal of the item 110 from the assembly 100 without separation of the top half 102 from the bottom half 104.

All the information relating to the delivery of the mailpiece, such as the addressee, the return addressee, the article number and their corresponding machine readable codes may be variably printed on both sides of the assembly 100, either by printing of each side simultaneously or multiple passes to complete the printing of the information.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A combined mailing assembly for mailing an article requiring delivery by a special service, the assembly comprising:

a sheet formed from only two layers in a first state defined between a first end and a second end of the sheet wherein the sheet is sealed at the first end of the sheet and further sealed at a point intermediate the first end and a second end of the sheet, and further sealed along two sides perpendicular to the first end and the second end and between the intermediate point and the second end to form an envelope having an interior compartment;

an opening between the first end and the second end providing access to the interior compartment wherein the opening is provided between the two layers; and a return postcard integrally formed at the first end by the seal securing the two layers at the first end to form each side of the return postcard and wherein the return postcard is separable from the envelope at the point intermediate the ends and further wherein the return postcard has information printed on each side necessary for the delivery of the mailpiece by the special service; and a removable strip adjacent the envelope including article identifying numbers related to the special service required by the article.

2. A method for forming a mailpiece for carrying an article requiring delivery by a special service, the method comprising the steps of:

providing a sheet;

folding the sheet forming only two layers in a first state defined between a first end and a second end of the folded sheet wherein the second end is opposite the first end;

sealing the sheet along two sides perpendicular to and between the first end and the second end to form an envelope having an interior compartment;

providing an opening between the first end and the second end for access to the interior compartment of the envelope wherein the opening is formed between the two layers;

integrally forming a return postcard with the envelope at the first end of the sheet by extending the seal between the two layers a distance from the first end such that each side of the sheet forms the return postcard wherein the return postcard has information printed on each of its sides necessary for delivery of the mailpiece by the special service;

inserting the article in the interior compartment for delivery; and removing a strip along the envelope wherein the strip includes article identifying numbers related to the special service required for the article.

* * * * *